US010928096B2

(12) United States Patent
Hickey et al.

(10) Patent No.: US 10,928,096 B2
(45) Date of Patent: Feb. 23, 2021

(54) ENVIRONMENTAL CONTROL UNIT INCLUDING NOISE REDUCTION FEATURES

(71) Applicants: Robert Bosch LLC, Broadview, IL (US); Robert Bosch GmbH, Stuttgart (DE)

(72) Inventors: Rob Hickey, Concord, NH (US); Armen Davtyan, Ashland, MA (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 144 days.

(21) Appl. No.: 16/017,693

(22) Filed: Jun. 25, 2018

(65) Prior Publication Data

US 2019/0003737 A1 Jan. 3, 2019

Related U.S. Application Data

(60) Provisional application No. 62/527,499, filed on Jun. 30, 2017.

(51) Int. Cl.
*F24F 13/24* (2006.01)
*F24F 13/20* (2006.01)

(52) U.S. Cl.
CPC ..... *F24F 13/24* (2013.01); *F24F 13/20* (2013.01); *F24F 2013/242* (2013.01); *F24F 2013/245* (2013.01)

(58) Field of Classification Search
CPC ..... F24F 13/24; F24F 13/20; F24F 2013/242
See application file for complete search history.

(56) References Cited

U.S. PATENT DOCUMENTS 1,938,800 A 12/1933 Bourne
1,938,801 A 12/1933 Bourne et al.
2,061,535 A 11/1936 Davies
2,286,491 A * 6/1942 Kueher ..... F24F 1/02 62/271
2,820,406 A 1/1958 Argentieri
3,033,307 A * 5/1962 Sanders ..... F01N 1/24 181/224
3,511,336 A * 5/1970 Rink ..... F04D 29/664 181/224
3,989,415 A 11/1976 Van-Hee et al.
4,508,486 A * 4/1985 Tinker ..... F04D 29/664 415/119

(Continued)

FOREIGN PATENT DOCUMENTS

EP 1686320 A2 12/2005

*Primary Examiner* — Frantz F Jules
*Assistant Examiner* — Lionel Nouketcha
(74) *Attorney, Agent, or Firm* — Kelly McGlashen; Maginot, Moore & Beck LLP

(57) ABSTRACT

An environmental control unit, such as an HVAC or heat pump unit, includes an insert disposed within the device housing that provides noise attenuation features. The insert defines air flow paths within the housing. The insert may be formed of a foam material and may include multiple foam blocks that cooperate to form a serpentine passageway therein. The passageway includes multiple turns. The features further include perforated sheet metal panels disposed in the passageway at strategic locations. The perforations are shaped and dimensioned to correspond to the frequencies to be attenuated.

15 Claims, 8 Drawing Sheets

(56) References Cited

U.S. PATENT DOCUMENTS

| | | | | |
|---|---|---|---|---|
| 4,991,406 | A * | 2/1991 | Fujii | F24F 1/56 62/259.1 |
| 5,274,201 | A | 12/1993 | Steele | |
| 5,663,535 | A | 9/1997 | MacDonald et al. | |
| 5,938,888 | A | 11/1999 | Anselmino et al. | |
| 5,983,888 | A * | 11/1999 | Anselmino | F04D 29/664 126/299 D |
| 6,131,696 | A | 10/2000 | Esslinger | |
| 6,253,873 | B1 * | 7/2001 | Norres | F16L 9/21 181/224 |
| 6,342,005 | B1 | 1/2002 | Daniels et al. | |
| 6,668,970 | B1 | 12/2003 | Lee | |
| 6,719,078 | B2 | 4/2004 | Nakamura | |
| 8,434,591 | B2 | 5/2013 | Cherniak et al. | |
| 8,540,557 | B1 * | 9/2013 | Derks | F24F 13/24 454/184 |
| 9,004,995 | B1 | 4/2015 | Derks et al. | |
| 9,305,539 | B2 * | 4/2016 | Lind | F24F 7/04 |
| 2008/0210188 | A1 * | 9/2008 | Koss | F02M 35/1216 123/184.21 |
| 2010/0077755 | A1 * | 4/2010 | Jangili | F01D 25/30 60/725 |
| 2015/0101883 | A1 | 4/2015 | Xu et al. | |
| 2015/0181759 | A1 | 6/2015 | Li et al. | |

* cited by examiner

ENVIRONMENTAL CONTROL UNIT INCLUDING NOISE REDUCTION FEATURES

CROSS REFERENCE TO RELATED APPLICATIONS

This application claims priority under 35 U.S.C. 119(e) to U.S. provisional patent application Ser. No. 62/527,499 filed on Jun. 30, 2017, the entire contents of which are incorporated by reference herein.

BACKGROUND

The present invention relates to reducing noise emission in residential or commercial heating, ventilation and/or air conditioning (HVAC) or heat pump units.

Heating or cooling equipment such as an HVAC or heat pump unit employing a compressor and/or fan are known to produce undesirable noise. In addition, the inlet as well as the outlet of such equipment are a noise source. For example, the fan and airflow noise of some residential/commercial HVAC or heat pump units, as well as compressor noise, may be transferred through the metal duct system to the living area or office spaces where low noise is desirable. Moreover, since HVAC or heat pump units, particularly residential units, are typically designed to be as compact as possible, achieving noise reduction in a very confined space is challenging.

SUMMARY

In one aspect, an environmental control unit such as an HVAC or heat pump unit provides noise attenuation by reducing noise before it enters the duct system. This is achieved by forcing a sound wave traveling through the HVAC or heat pump housing to pass through a labyrinth passageway that causes the sound wave to be reflected multiple times (e.g., two, three or more times) before being transmitted into a duct system. The passageway is part of an insert provided in the housing. The insert is formed of an acoustically absorbing material. The insert lines at least a portion of the inner surface of the housing, and may encompass one or more of the mechanical components (e.g., fan, heat exchanger, compressor, etc.) of the HVAC or heat pump. The passageway is integrally formed within the insert, such that surfaces of the passageway are the acoustically absorbing material. The passageway is formed having multiple turns, and may also include strategically located perforated panels. The panels are supported on a surface of the passageway and are configured (e.g., tuned) to attenuate noise at one or more predetermined frequencies.

The acoustically absorbing material used to form the insert may be, for example, a foam or other appropriate material. In some embodiments, the material is a specialized structural foam, for example a closed-cell, extruded, polystyrene foam such as the foam sold under the trademark Styrofoam or an expanded polypropylene (EPP). Advantageously, the acoustically absorbing material both absorbs sound and reduces parasitic losses from secondary flows within the passageway. As such, the passageway formed of the acoustically absorbing material has less losses than some similar passageways formed of sheet metal.

In some embodiments, the insert includes internal vacancies that receive components of the heat pump such as the fan or compressor. In the case of the fan, the internal vacancy may be shaped to closely fit the shape and size of the fan including the volute. Alternatively, the fan may be provided without a volute, and the fan vacancy may be shaped as a volute to provide the function of the volute. The volute shaped vacancy advantageously absorbs sound due at least in part to the material of surface of the volute, and also reduces parasitic losses from secondary flows.

When compared to conventional duct silencers, liners and wraps, the insert advantageously provides reduced sound production from HVAC unit itself, minimizing or silencing altogether the unwanted fan and compressor noise before it has a chance to propagate outside the HVAC unit. In addition, the insert reduces installation costs and allows for sound reduction where conventional duct noise reduction techniques are not feasible (e.g., existing home installations, etc.).

The insert allows further noise reduction compared to standard HVAC systems when combined with one or more conventional noise reduction methods that are provided in the duct work.

In some constructions, the system can be a retrofit kit for already installed HVAC/heat pump units. Alternately, the system can be integrated into an HVAC/heat pump unit as originally manufactured, providing a quieter base unit which can achieve lower noise with conventional ducts, and which can achieve even greater noise reduction when used with known duct silencing devices.

Further advantageously, the insert can be manufactured in such a way as to be usable in various sized HVAC or heat pump units, further reducing manufacturing costs. For example, in some embodiments, the insert is manufactured in a size appropriate for the largest sold equipment, and then cut or trimmed to accommodate a smaller sized equipment. In other embodiments, the insert is formed of an assembly of multiple individual foam elements. The foam elements are modular in nature, and fewer pieces are assembled to accommodate a smaller device, and relatively more pieces are assembled to accommodate a larger device.

It is understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
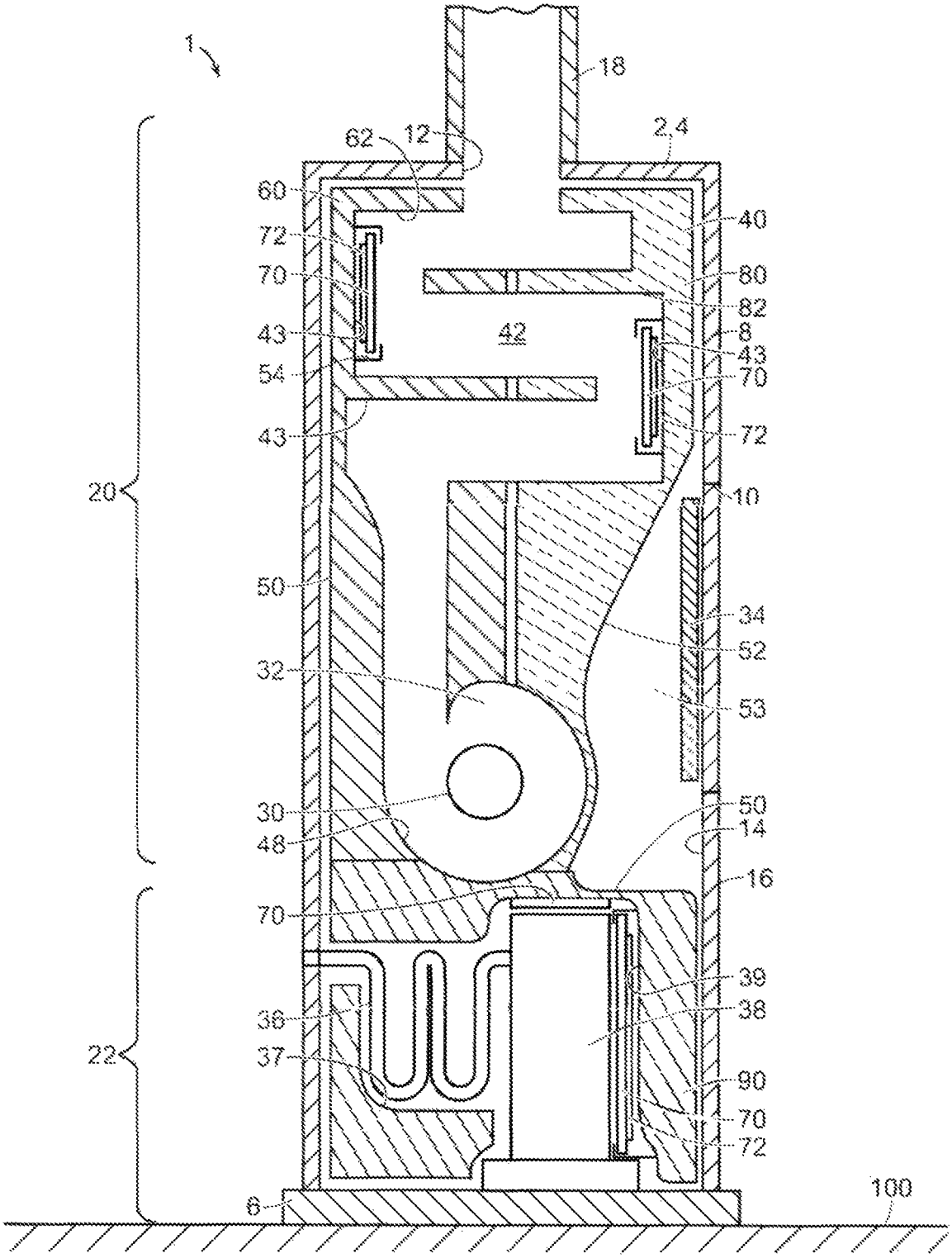
FIG. 1 is a side sectional view of a heat pump including an insert that provides noise reduction features.
Figure 2:
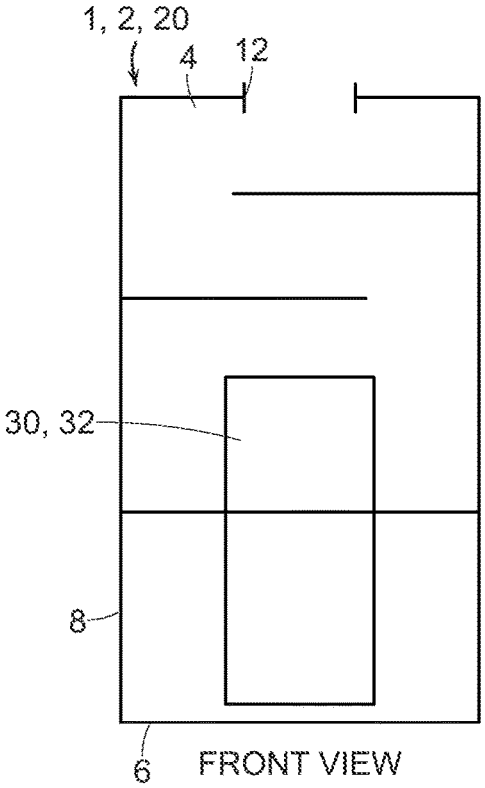
FIG. 2 is a schematic front view of an upper portion of the heat pump housing illustrating how airflow is intended to be directed.
Figure 3:
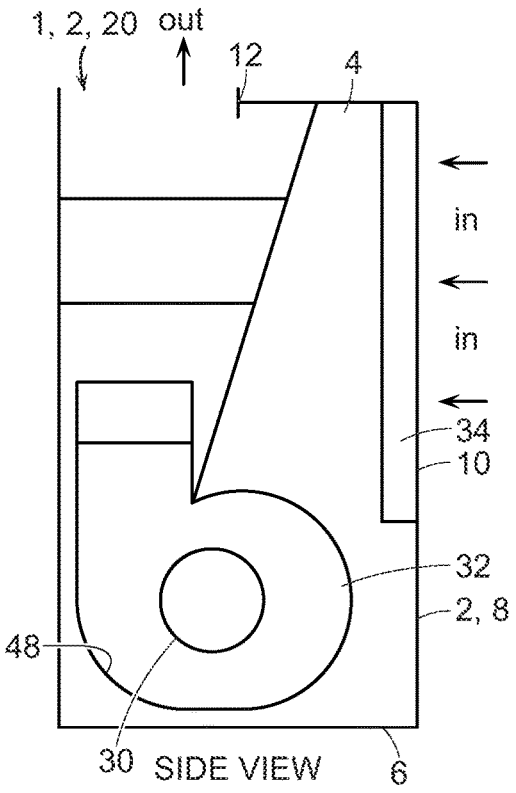
FIG. 3 is a schematic side view of the heat pump housing of FIG. 2.
Figure 4:
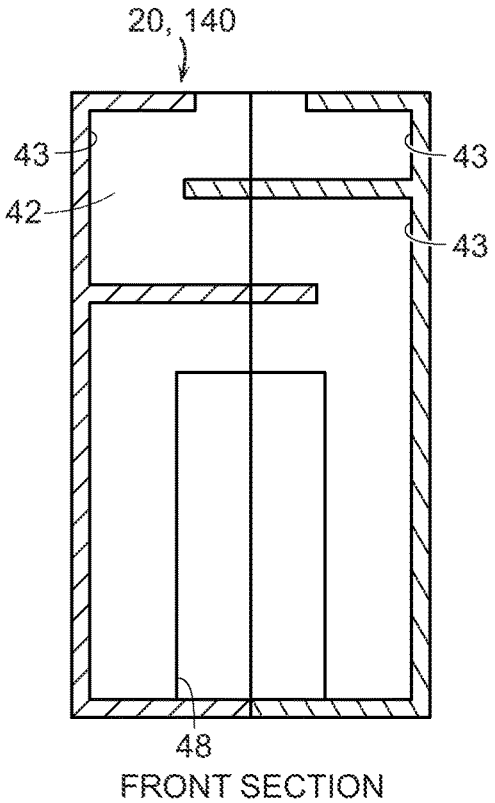
FIG. 4 is a schematic front view of an alternative embodiment insert.
Figure 5:
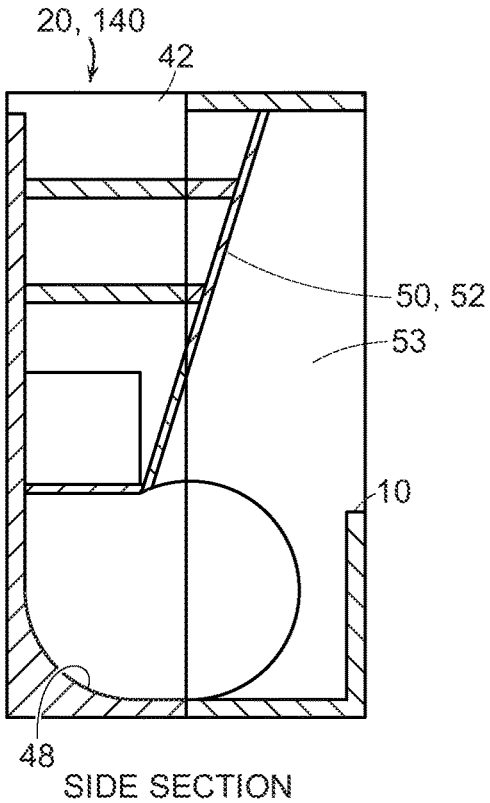
FIG. 5 is a schematic side view of the insert of FIG. 4.
Figure 6:
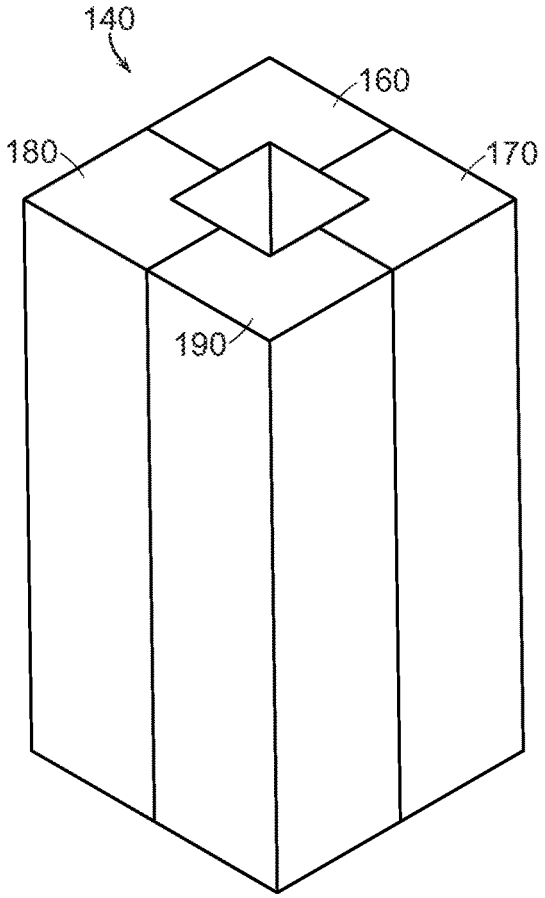
FIG. 6 is a perspective view of the insert of FIG. 4 illustrating that the insert is an assembly of four blocks.
Figure 7:
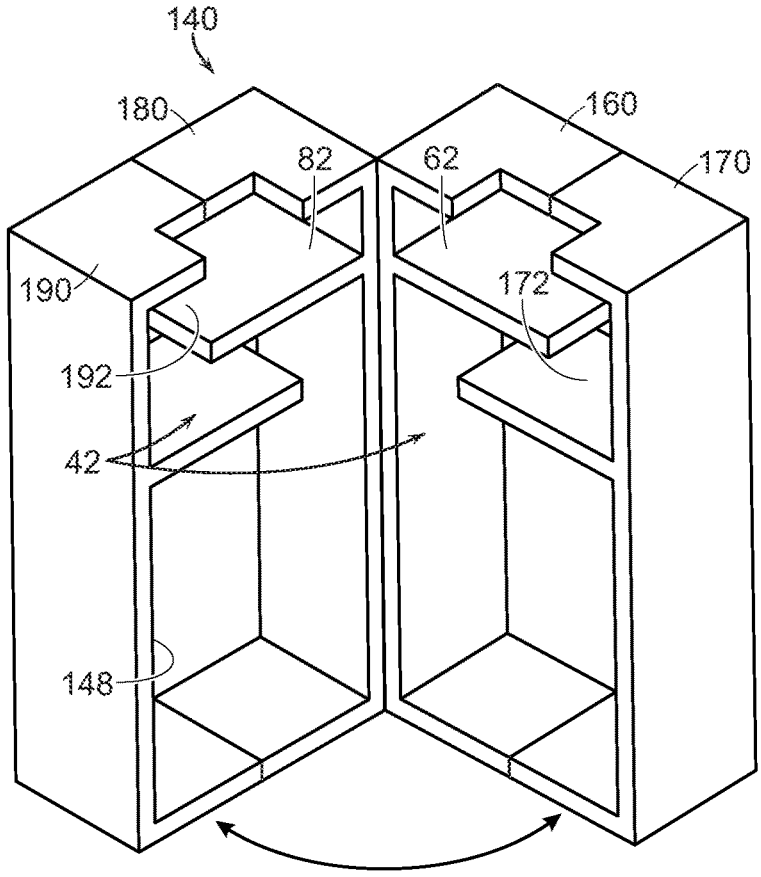
FIG. 7 is a perspective view of the insert of FIG. 4 illustrating the blocks of the insert separated along a vertical midline of the insert to allow the labyrinthian passageway and fan vacancy to be viewed.

Referring to FIGS. 1-3, an environmental control unit such as a heat pump 1 includes features that provide noise attenuation within the heat pump housing 2, and particularly in the air flow path through the heat pump 1. The heat pump 1 includes the housing 2, and also includes a compressor 38, a fan 30, a condensing heat exchanger 34, an evaporating heat exchanger 36 and power and control electronics (not shown) disposed in the housing 2. The heat pump 1 may also include other ancillary devices (not shown) disposed in the housing 2 that facilitate operation of the heat pump 1, such as a reversing valve and/or other types of valves, sensors, hoses, etcetera.

The housing 2 includes a closed first end 6 that rests on a support surface 100 such as the ground, a floor or a shelf. The housing 2 includes a closed second end 4 that is spaced apart from the first end 6, and a sidewall 8 that extends between the first end 6 and the second end 4. The housing 2 includes an air inlet 10 formed in the sidewall between the first and second ends 6, 4 and an air outlet formed in the second end 4. The condensing heat exchanger 34 is disposed in the housing 2 at a location corresponding to the air inlet 10, and air entering the housing 2 passes through the condensing heat exchanger 34. The compressor 38 is disposed in the housing 2 adjacent to the first end 6. In the illustrated embodiment, the compressor 38 rests on an inner surface 14 of the housing at the first end 6. The fan 30 may be for example a squirrel cage blower, and is disposed in the housing 2 at a location above the compressor 38, and serves to draw air through the coils of the heat exchanger 34. Air conditioned by the heat exchanger 34 is drawn into an inlet of the fan 30, and then exhausted from an outlet of the fan 30 and directed toward the housing air outlet 12 via a passageway 42 that is discussed further below.

The heat pump 1 also includes an insert 40 disposed in the housing 2 between the mechanical components 30, 34, 36, 38 and the housing inner surface 14. The insert 40 includes noise attenuation features. In addition, the insert 40 fills a substantial portion of the space between adjacent mechanical components and between the mechanical components and the housing inner surface 14, with a few exceptions described below.

The insert 40 is formed having interior vacancies. One vacancy provides the passageway 42 that provides a fluid path between an outlet of the fan 30 and the housing air outlet 12. Other vacancies 37, 39 receive the compressor 38 and the fan 30.

The passageway 42 is formed in the insert 40 in a serpentine pattern so as to have multiple turns 43, which serve as noise attenuation features. For example, in the illustrated embodiments, the passageway includes three turns 43. It is understood, however, that a greater or fewer number of turns can be used to form the passageway 42.

The insert 40 may also include strategically located perforated panels 70 which serve as noise attenuation features. The panels 70 are thin metal plates that are supported on surfaces of the passageway 42. For example, in some embodiments the passageway 42 includes a slot 54 for each panel 70. The slots 54 receive the panels 70 and support the peripheral edges of the panels 70 so that a surface of the panels 70 is exposed to air flow through the passageway 42. In other embodiments, the passageway 42 includes a recess (not shown) for each panel 70, and the panels 70 are supported within the corresponding recess so that a surface of the panel 70 is exposed to air flow through the passageway 42. The panels 70 are strategically located within the passageway turns 43 maximize their attenuating effect.

Figure 18:
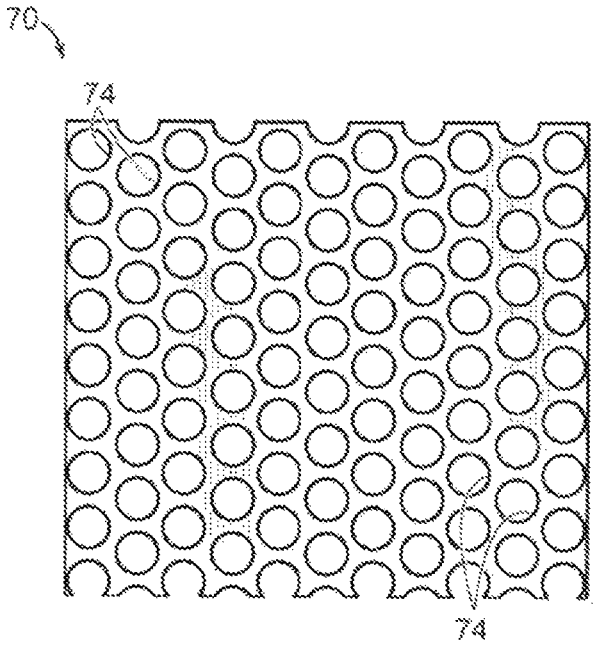
FIG. 18 is an enlargement of a portion of an exemplary perforated panel.
Figure 19:
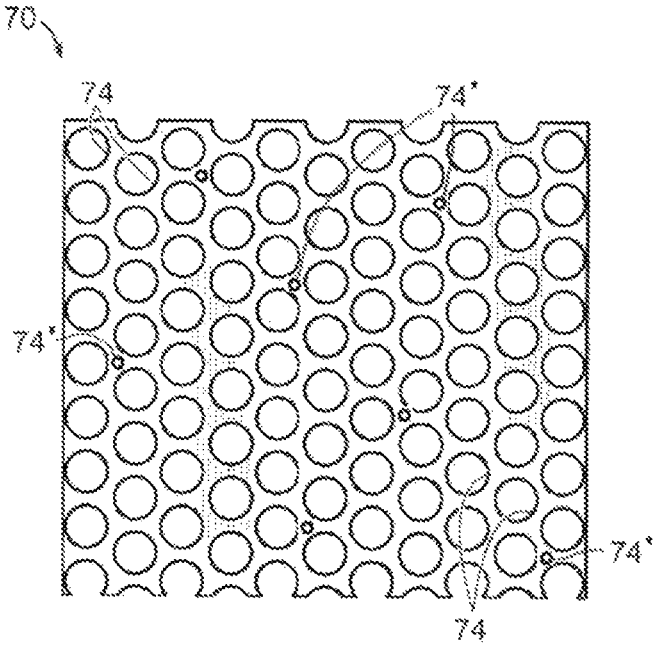
FIG. 19 is an enlargement of a portion of another exemplary perforated panel.

The perforations 74 may be circular in shape, and the size and pattern of the perforations 74 can be adjusted to correspond to sound frequencies to be attenuated (FIG. 18). A given panel 70 may be tuned to attenuate sound at a single frequency or at multiple frequencies. For example, a panel 70 may include first perforations 74 that are sized and dimensioned to provide noise attenuation at a first predetermined frequency, and second perforations 74' that are sized and dimensioned to provide noise attenuation at a second predetermined frequency, where the first predetermined frequency is different than the second predetermined frequency (FIG. 19).

In some embodiments, a layer of fiberglass in the form of a mat 72 is disposed between each panel 70 and a facing surface of the passageway 42. The mat 72 provides additional acoustic dampening within the passageway 42, beyond what is achieved using the labyrinthian passageway 42 and the panels 70.

Thus, the noise attenuation features, including the labyrinthian passageway 42, the panels 70 and the mats 72, are disposed in the housing 2 in the air flow path between the housing air inlet 10 and the housing air outlet 12.

In addition to the passageway 42, the insert 40 may include additional internal vacancies. For example, the insert 40 includes a fan vacancy 48 that is shaped and dimensioned to closely accommodate the fan 30 including the volute 32.

It is contemplated that the fan volute 32 can be omitted, and the fan vacancy 48 can be formed in the shape of the volute 32, whereby heat pump manufacturing costs may be reduced. Moreover, since the fan volute 32 would be formed of the acoustically absorbing material, further noise reduction may be achieved and parasitic losses due to secondary air flows are reduced.

In the illustrated embodiment, additional internal vacancies 37, 39 are provided that accommodate the compressor 38 and evaporative heat exchanger 36.

The insert 40 may also include vacancies formed in an outer surface 50 thereof. For example, the insert 40 includes an outer surface portion 52 that is angled away from the housing inner surface 14 in the vicinity of the housing air inlet opening 10. The angled portion 52 defines an air flow inlet passageway 53 that directs air from the air inlet opening 10 to an inlet of the fan 30.

The insert 40 is an assembly of multiple individual blocks 60, 80, 90. Each individual block 60, 80, 90 is formed of the same acoustically absorbing material, for example the foam or other appropriate material. The blocks 60, 80 and 90 are modular in nature, and thus in some embodiments, fewer pieces may be assembled to accommodate a smaller heat pump, and relatively more pieces may be assembled together to accommodate a larger heat pump.

The first block 60 and the second block 80 each include a corresponding passageway portion 62, 82 that is configured so that when the first and second blocks 60, 80 are assembled together, the passageway 42 is formed. The first and second blocks 60, 80 are positioned in the housing 2 adjacent to the second end 4 such that an outlet of the passageway 42 is aligned with the housing air outlet 12. In addition, the first and second blocks 60, 80 together form the fan vacancy 48. The angled portion 52 of the insert outer surface is formed along one side of the second block 80. The third block 90 is disposed in the housing 2 at a location below the fan 30 and below the first and second blocks 60, 80. The third block 90 includes the vacancies 37, 39 that encompass the evaporative heat exchanger 36 and compressor 38. In some embodiments, the compressor vacancy 39 may include one or more panels 70 that includes perforations 74 tuned to the noise generated by the compressor 38.

In some embodiments, the blocks 60, 80, 90 are retained in the assembled configuration shown in FIG. 1 by the constraints of the size and shape of the housing 2. In other embodiments, the blocks 60, 80, 90 are mechanically connected, for example via an adhesive or via surface features (for example, interlocking elements, not shown) provided on the respective adjoining edges.

In the illustrated embodiment, all the blocks 60, 80, 90 of the insert 40 are formed of the same material. However, it is understood that one or more of the blocks may be formed of a different material.

Referring to FIGS. 4-7, an alternative embodiment insert 140 is similar to the insert 40 described above with respect to FIGS. 1-3, and elements common to both embodiments have the same reference number. The insert 140 of FIGS. 4-7 differs from the earlier-described embodiment in that it employs a different block configuration. For example, the insert 140 is an assembly of four blocks 160, 170, 180, 190, where the insert 140 is sectioned vertically into four quadrants, each quadrant corresponding to an individual block 160, 170, 180, 190. The illustrated blocks 160, 170, 180, 190 correspond to an upper portion 20 (see FIG. 1) of the heat pump 1, and the insert 140 may include one or more additional blocks (not shown) that correspond to a lower portion 22 of the heat pump 1.

The insert 140 includes internal vacancies that provide the passageway 42 as described above, and further includes vacancies for the system components such as the fan 30. However, the insert 140 has a uniform wall thickness throughout, whereby, for example, the fan vacancy 140 has a rectangular profile that does not necessarily closely encompass the fan and volute.

Figure 9:
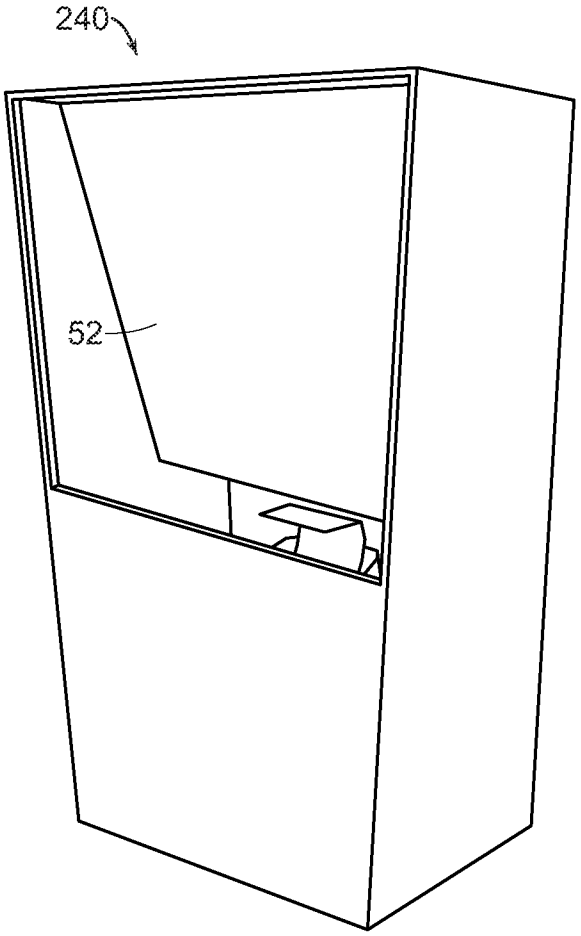
FIG. 9 is a rear perspective view of the insert of FIG. 8.
Figure 8:
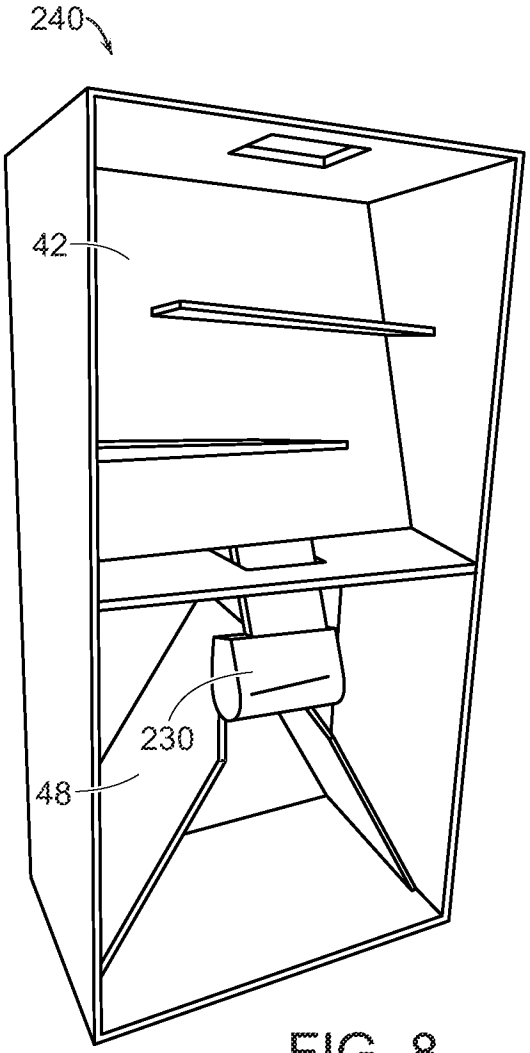
FIG. 8 is a front perspective view of a mock up of another alternative embodiment of the insert.
Figure 10:
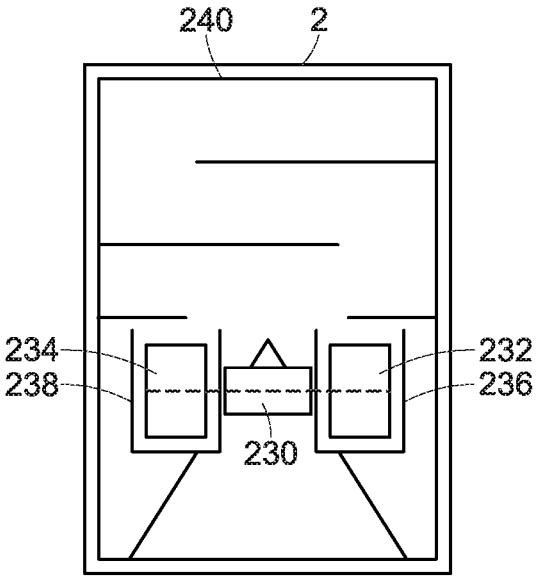
FIG. 10 is a schematic sectional view of the insert of FIG. 8.
Figure 11:
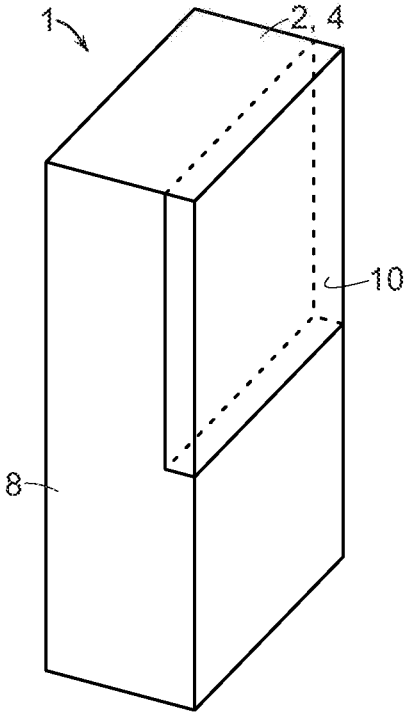
FIGS. 11-14 are various schematic views of a heat pump illustrating proposed changes in placement of the internal components within the heat pump housing to accommodate the presence of the insert.
Figure 14:
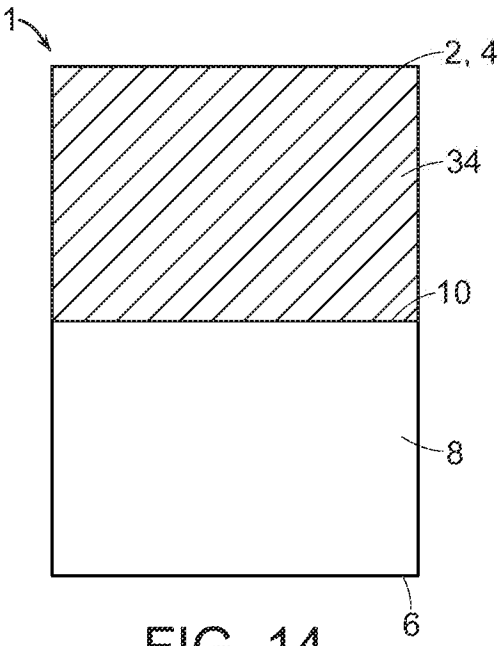
Figure 13:
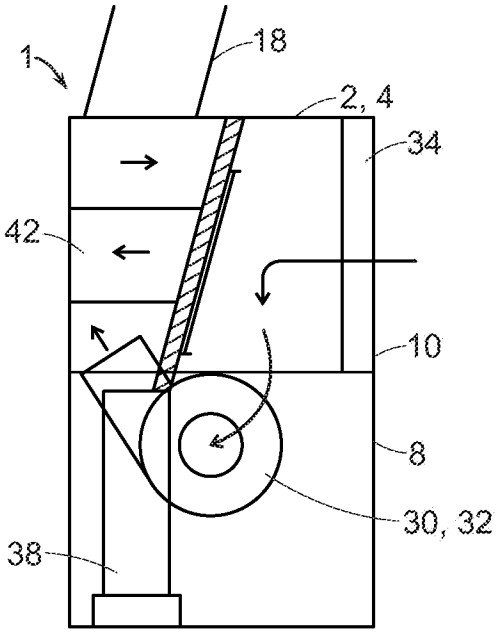
Figure 12:
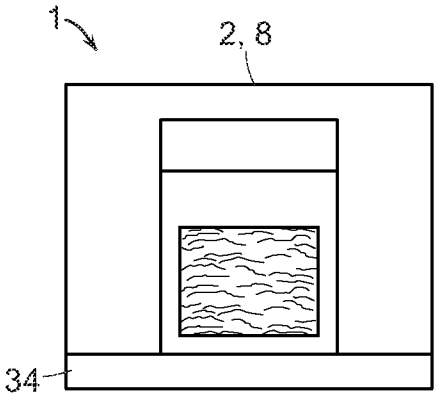

Referring to FIGS. 8-10, another alternative insert 240 is similar to the inserts 40, 140 described above, and common reference numbers are used to refer to common elements. The insert 240 of FIGS. 8-10 includes the passageway 42 as described above, and a fan vacancy 48 disposed below the passageway 42. In this case, the fan vacancy 48 accommodates an alternative embodiment fan 230. The fan 230 includes a fan motor 234 having a dual axle output shaft, and further includes a squirrel cage 232, 234 mounted on each axle. The insert 240 is similar to the insert 40 in that it closely encompasses the fan 230 (this is represented in FIGS. 8 and 9 as a generally triangular element having a cut-away portion that receives the fan 230). In addition, the insert 240 defines a volute 236, 238 that surrounds each squirrel cage 232, 234. Since the insert 240 provides the volutes 236, 238 further noise reduction may be achieved and parasitic losses due to secondary air flows are reduced. In addition, since two squirrel cages are used, the squirrel cages and corresponding volutes can be made smaller in size and moved to lateral aspects of the housing, whereby packaging of the heat pump and its components can be made more compact.

Figure 15:
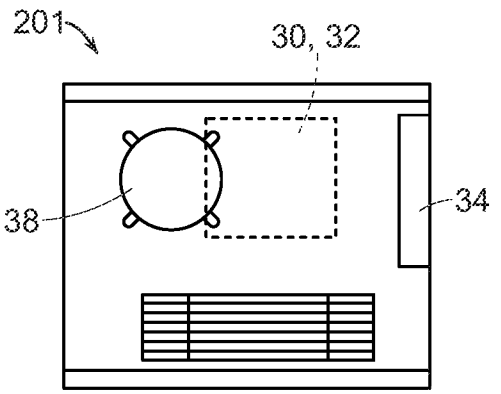
FIG. 15 Prior Art
FIGS. 15-17 are various schematic views of a conventional heat pump illustrating one conventional placement of components within the heat pump housing.
Figure 16:
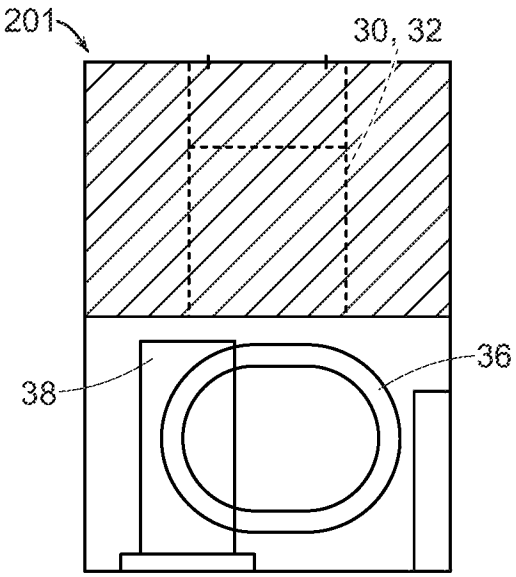
FIG. 16 Prior Art
Figure 17:
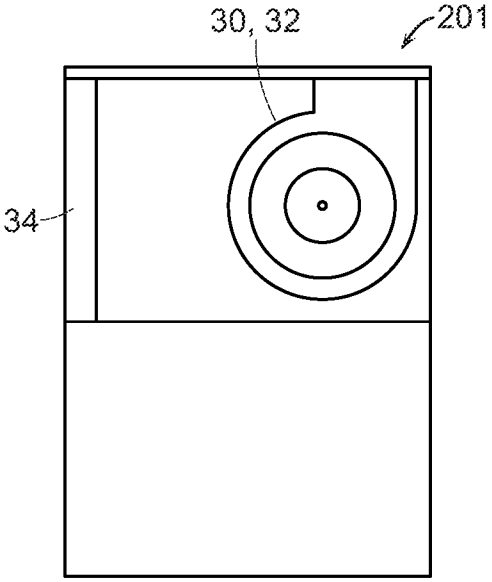
FIG. 17 Prior Art

Referring to FIGS. 11-14, in addition to providing noise attenuating features, use of the insert 40, 140, 240 in the heat pump 1 has other advantages, such as permitting some rearrangement of heap pump components (e.g., fan, compressor, electronics, etc) within the housing 2. FIGS. 11-14 provide various views of the housing 2 and illustrate for example, the fan 30 disposed in the housing at a location that is downward and closer to the compressor relative to the configuration of some conventional heat pumps (represented in FIGS. 15-17). As a result of the compact arrangement of the components shown in FIGS. 11-14, the heat pump 1 including the insert 40, 140, 240 can be made within a housing 2 having the approximately the same general overall dimensions as the conventional unit without the insert 40, 140, 240. Moreover, it is contemplated that an overall reduction in heat pump size may also be achieved.

The heat pump 1 including noise reduction features has been described herein in some detail as an example of how the noise reduction features can be incorporated into an environmental control unit. It is understood that the noise reduction features can be incorporated into other types of heat pumps, as well as other types of environmental control units, including, but not limited to, cooling units and/or air handling units.

Selective illustrative embodiments of the heat pump and insert are described above in some detail. It should be understood that only structures considered necessary for clarifying the heat pump and insert have been described herein. Other conventional structures, and those of ancillary and auxiliary components of the heat pump and insert, are assumed to be known and understood by those skilled in the art. Moreover, while a working example of the heat pump and insert have been described above, the system, the heat pump and insert are not limited to the working examples described above, but various design alterations may be carried out without departing from the heat pump and insert as set forth in the claims.

What is claimed is:

1. An environmental control unit comprising, a housing including a closed first end that rests on a support surface, a closed second end that is spaced apart from the first end, a sidewall that extends between the first end and the second end, an air inlet, and an air outlet, a heat exchanger disposed in the housing, a compressor disposed in the housing, a fan disposed in the housing, the fan configured to draw air through the heat exchanger, and noise attenuation features disposed in the housing, the noise attenuation features including an insert that comprises an internal vacancy that defines a passageway, the passageway having a first turn and a second turn that is downstream of the first turn with respect to a direction of air flow through the passageway, the passageway receiving fan exhaust and directing the fan exhaust to the air outlet, wherein the insert includes a first block formed of a first material and including a first portion of the passageway, a second block formed of the first material and including a second portion of the passageway, wherein the first block and the second block are assembled together to form the insert, and the first portion and the second portion cooperate to define the passageway, a first panel formed of a second material that is different from the first material, the first panel supported within the insert so that a surface of the first panel is exposed to air flow within the passageway, the surface of the first panel including first perforations that are shaped and dimensioned to provide noise attenuation at a first predetermined frequency, and a second panel formed of the second material, the second panel supported within the insert so that a surface of the second panel is exposed to air flow within the passageway, the surface of the second panel including the first perforations, and wherein the first panel is disposed at the first turn of the passageway such that the first panel is perpendicular to the direction of the air flow as the air flow enters the first turn, and the second panel is disposed at the second turn of the passageway such that the second panel is oriented perpendicular to the direction of the air flow as the air flow enters the second turn.

2. The environmental control unit of claim 1, wherein the first panel includes second perforations that are shaped and dimensioned to provide noise attenuation at a second predetermined frequency, and the first predetermined frequency is different than the second predetermined frequency.

3. The environmental control unit of claim 1, wherein the first material is a foam and the second material is a metal.

4. The environmental control unit of claim 1, wherein the first panel is received within a slot formed in a surface of the passageway.

5. The environmental control unit of claim 1, wherein the first panel is received within a recess formed in a surface of the passageway.

6. The environmental control unit of claim 1, wherein the fan is disposed in a fan vacancy formed in the insert, and the insert is disposed adjacent the air outlet such that air discharged from the fan passes through the passageway before exiting the housing via the air outlet.

7. The environmental control unit of claim 6, wherein the fan is volute-free and the fan-vacancy is shaped and dimensioned to have the shape and dimension of a volute that is configured to be used with the fan.

8. The environmental control unit of claim 1, wherein the fan includes a volute, and a portion of the internal vacancy is shaped and dimensioned to have the shape and dimension of the volute.

9. The environmental control unit of claim 1, wherein the passageway has at least three turns.

10. The environmental control unit of claim 1, wherein a portion of an outer surface of the insert that faces the air inlet is angled relative to the sidewall.

11. The environmental control unit of claim 1, wherein the first panel includes second perforations, the second perforations are different from the first perforations in at least one of shape and dimension, the second perforations are sized and dimensioned to provide noise attenuation at a second predetermined frequency, and the first predetermined frequency is different than the second predetermined frequency.

12. An environmental control unit comprising, a housing including an air inlet, and an air outlet, a heat exchanger disposed in the air inlet of the housing, a compressor disposed in the housing, a fan disposed in the housing, the fan configured to draw air through the heat exchanger, and a noise attenuation insert disposed in the housing, the noise attenuation insert being formed of an acoustically absorbent material and comprising an internal vacancy that defines a passageway, the passageway having a first turn and a second turn that is downstream of the first turn with respect to a direction of air flow through the passageway, the passageway receiving fan exhaust and directing the fan exhaust to the air outlet, the noise attenuation insert including a first panel formed of a second material that is different from the acoustically absorbent material used to form the insert, the first panel supported within the insert so that a surface of the first panel is exposed to air flow within the passageway, the surface of the first panel including first perforations that are shaped and dimensioned to provide noise attenuation at a first predetermined frequency, and a second panel formed of the second material, the second panel supported within the insert so that a surface of the second panel is exposed to air flow within the passageway, the surface of the second panel including the first perforations, wherein the first panel is disposed at the first turn of the passageway such that the first panel is perpendicular to the direction of the air flow as the air flow enters the first turn, and the second panel is disposed at the second turn of the passageway such that the second panel is oriented perpendicular to the direction of the air flow as the air flow enters the second turn.

13. The environmental control unit of claim 12, wherein the insert includes a first block formed of the first material and including a first portion of the passageway, and a second block formed of the first material and including a second portion of the passageway, Wherein the first block and the second block are assembled together to form the insert, and the first passageway portion and the second passageway portion cooperate to define the passageway.

14. The environmental control unit of claim 12, wherein a sheet of a third material is disposed between the first panel and a surface of the passageway.

15. The environmental control unit of claim 12, wherein the first panel includes second perforations, the second perforations are shaped and dimensioned to provide noise attenuation at a second predetermined frequency, the second perforations are different from the first perforations in at least one of shape and dimension, and the first predetermined frequency is different than the second predetermined frequency.

* * * * *